US009627815B2

(12) United States Patent
Wu et al.

(10) Patent No.: US 9,627,815 B2
(45) Date of Patent: Apr. 18, 2017

(54) RECEPTACLE CONNECTOR FOR CABLE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/081,962

(22) Filed: Mar. 28, 2016

(65) Prior Publication Data

US 2016/0285208 A1 Sep. 29, 2016

(30) Foreign Application Priority Data

Mar. 27, 2015 (CN) ..... 2015 2 0177623 U

(51) Int. Cl.

| | |
|---|---|
| ***H01R 13/68*** | (2011.01) |
| ***H01R 13/6581*** | (2011.01) |
| ***H01R 13/50*** | (2006.01) |
| ***H01R 24/62*** | (2011.01) |
| ***H01R 43/18*** | (2006.01) |
| *H01R 107/00* | (2006.01) |

(Continued)

(52) U.S. Cl.

CPC ..... *H01R 13/6581* (2013.01); *H01R 13/50* (2013.01); *H01R 24/62* (2013.01); *H01R 43/18* (2013.01); *H01R 12/53* (2013.01); *H01R 13/6582* (2013.01); *H01R 2107/00* (2013.01)

(58) Field of Classification Search

CPC .... H01R 13/50; H01R 13/6581; H01R 24/62; H01R 43/18; H01R 12/53; H01R 13/6582; H01R 2107/00

USPC ..... 439/607.27, 607.01, 607.49, 607.48, 439/607.4, 607.45, 607.47

See application file for complete search history.

(56) References Cited

U.S. PATENT DOCUMENTS 5,199,903 A * 4/1993 Asick ..... H01R 9/032 439/585

5,941,733 A * 8/1999 Lai ..... H01R 13/582 439/607.01

(Continued)

*Primary Examiner* — Abdullah Riyami

*Assistant Examiner* — Nelson R Burgos-Guntin

(74) *Attorney, Agent, or Firm* — Wei Te Chung; Ming Chieh Chang

(57) ABSTRACT

A receptacle connector assembly has a first shell including a plurality of side walls, a receiving cavity surrounded by the side walls and extending therethrough along a front-to-back direction. A number of spring fingers are formed on the respective side walls and protruding inwardly into the receiving cavity. A number of punched holes receiving the respective spring fingers communicate with the receiving cavity. An insulative body includes a base assembled to the first shell and a tongue extending forwardly therefrom. The tongue is received in the receiving cavity and has a top face and a bottom face disposed in a vertical direction. A number of contacts are arranged in a side-by-side manner along a transverse direction perpendicular to the front-to-back direction and the vertical direction. A second shell covers the first shell and encloses the punched holes therein. An insulative case encloses the second shell therein.

20 Claims, 6 Drawing Sheets

(51) Int. Cl.
*H01R 12/53* (2011.01)
*H01R 13/6582* (2011.01)

(56) References Cited

U.S. PATENT DOCUMENTS 5,961,350 A * 10/1999 Shiu ..... H01R 12/7017 439/108
6,193,554 B1 * 2/2001 Wu ..... H01R 24/62 439/607.25
6,264,504 B1 * 7/2001 Wu ..... H01R 23/6873 439/357
6,379,184 B1 * 4/2002 Bassler ..... H01R 13/6625 439/607.27
6,595,801 B1 * 7/2003 Leonard ..... H01R 13/6485 439/607.11
6,612,868 B2 * 9/2003 Hwang ..... H01R 13/65802 385/92
7,845,983 B2 * 12/2010 Kawada ..... H01Q 1/1271 439/607.46
8,052,467 B1 * 11/2011 Xie ..... H01R 13/5219 439/589
8,052,477 B1 * 11/2011 Ko ..... H01R 27/00 439/660
8,794,981 B1 8/2014 Rodriguez et al.
2002/0045385 A1 * 4/2002 Wang ..... H01R 13/6593 439/607.48
2003/0104725 A1 * 6/2003 Kerlin ..... H01R 13/65802 439/607.27
2005/0260884 A1 11/2005 Yueh
2010/0112863 A1 * 5/2010 Xiao ..... H01R 27/02 439/607.27
2015/0171562 A1 6/2015 Gao et al.
2015/0255905 A1 9/2015 Little et al.
2015/0288107 A1 10/2015 Wu et al.
2015/0325944 A1 11/2015 Chien et al.

* cited by examiner

RECEPTACLE CONNECTOR FOR CABLE

BACKGROUND OF THE INVENTION

1. Field of the Invention

The present invention relates to a receptacle connector assembly, and more particularly to a receptacle connector assembly having an insulative housing over molded on an metallic shell.

2. Description of Related Arts

U.S. Pat. No. 8,052,477 discloses a receptacle connector assembly including a metallic shell with a receiving cavity, a tongue with a set of contacts received in the receiving cavity, a cable connected with the contacts, and an insulative case covering the metallic shell. The metallic shell has a plurality of spring fingers and a plurality of punched holes formed by stamping the spring fingers. The insulative housing is usually over molded on the metallic shell. Anyhow, the metallic shell has the punched holes that the raw housing liquid is unexpectedly going through the punched holes into the receiving cavity when the insulative housing is being over molded to the metallic shell.

Therefore, a receptacle connector for a cable is desired.

SUMMARY OF THE INVENTION

Accordingly, an object of the present invention is to provide a receptacle connector assembly having a first metallic shell including a plurality of side walls, a receiving cavity surrounded by the side walls and extending therethrough along a front-to-back direction. A plurality of spring fingers are formed on the respective side walls and protruding inwardly into the receiving cavity. A plurality of punched holes receiving the respective spring fingers communicate with the receiving cavity. An insulative body includes a base assembled to the first metallic shell and a tongue extending forwardly therefrom. The tongue is received in the receiving cavity and has a top face and a bottom face disposed in a vertical direction. A plurality of contacts are arranged in a side-by-side manner along a transverse direction perpendicular to the front-to-back direction and the vertical direction. Each of the contacts has a contacting portion exposed on the top face. A second metallic shell covers the first metallic shell and encloses the punched holes therein. An insulative case encloses the second metallic shell therein. Notably, the second metallic shell is disposed between the first metallic shell and the insulative case. The punched holes are sealed by the second metallic shell that the raw housing liquid could not flow into the punched hole when the insulative housing is being over molded on the second shell.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to some preferred embodiments of the present invention.

Figure 1:
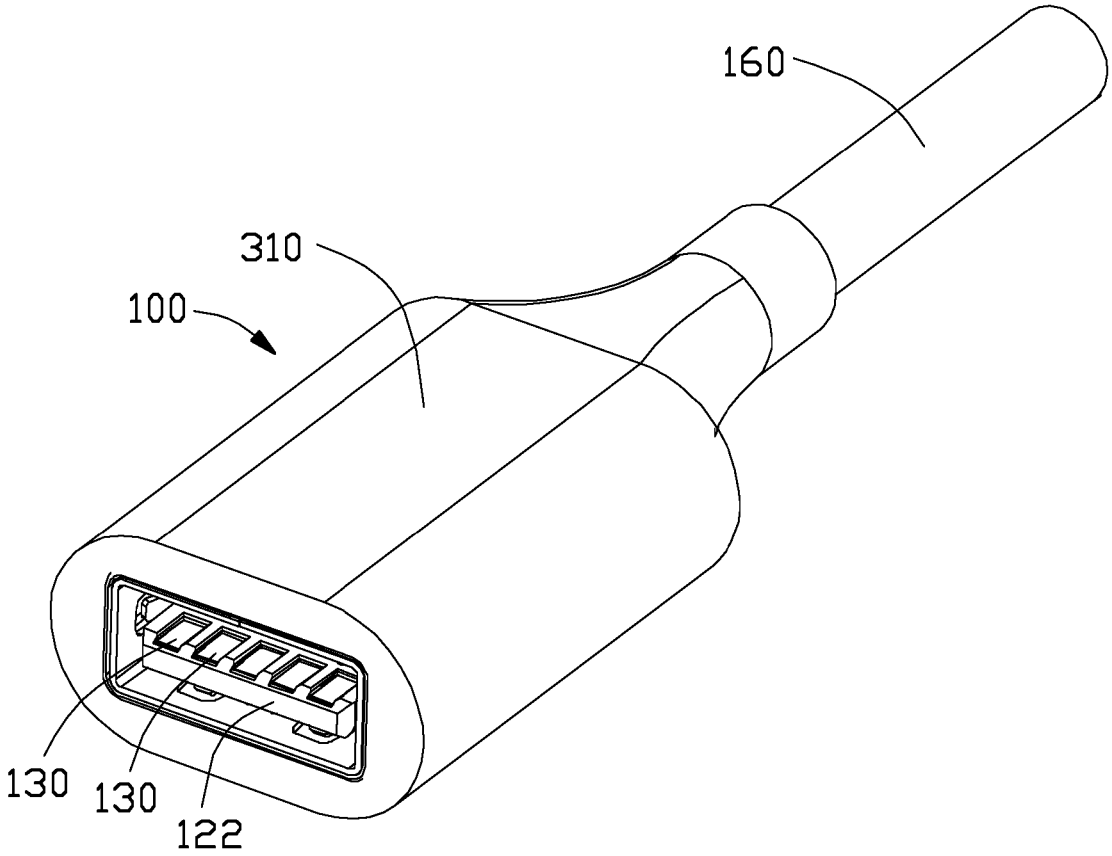
FIG. 1 is a front perspective view of a receptacle connector assembly in accordance with the present invention.
Figure 2:
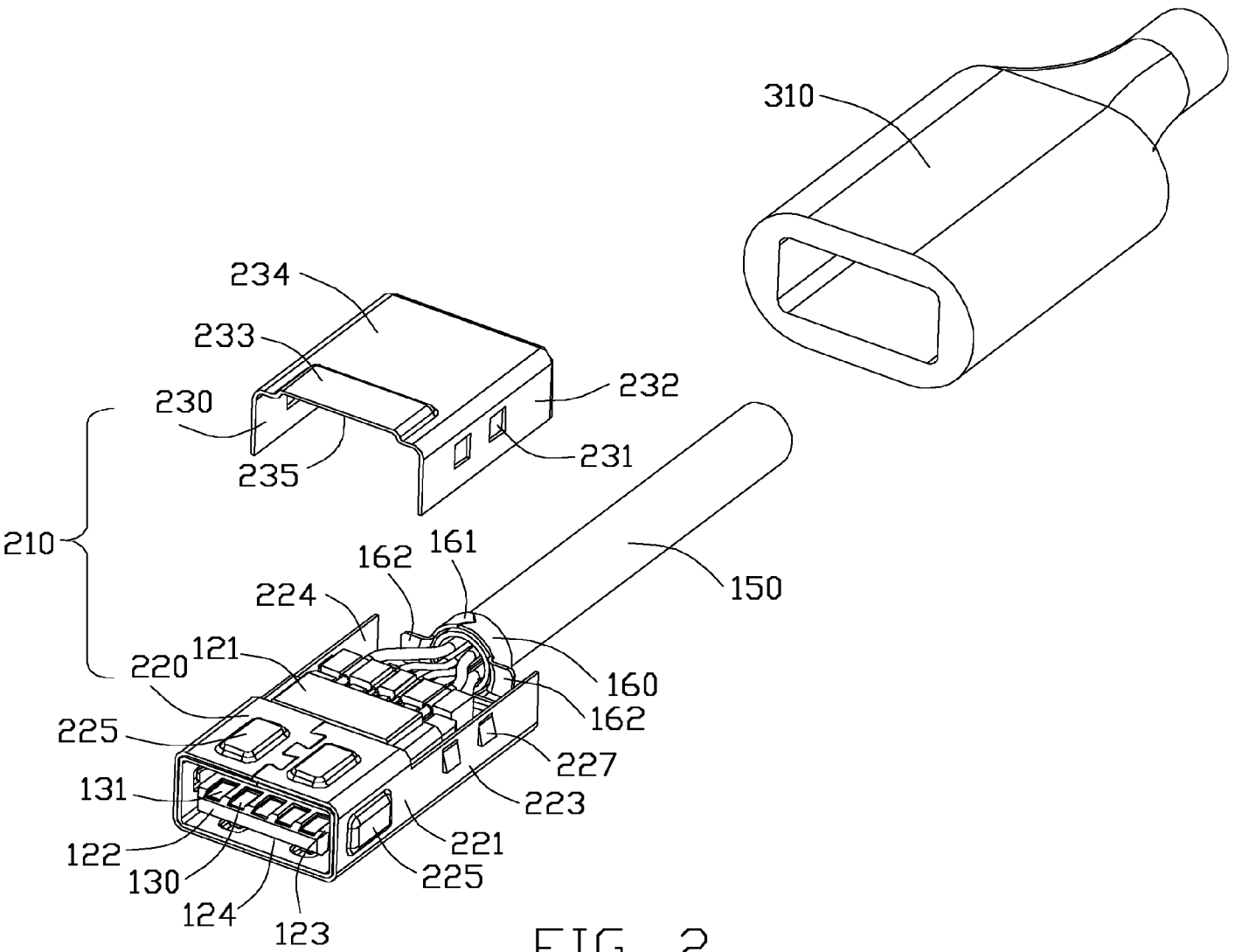
FIG. 2 is a front exploded perspective view of the receptacle connector assembly as shown in FIG. 1.
Figure 3:
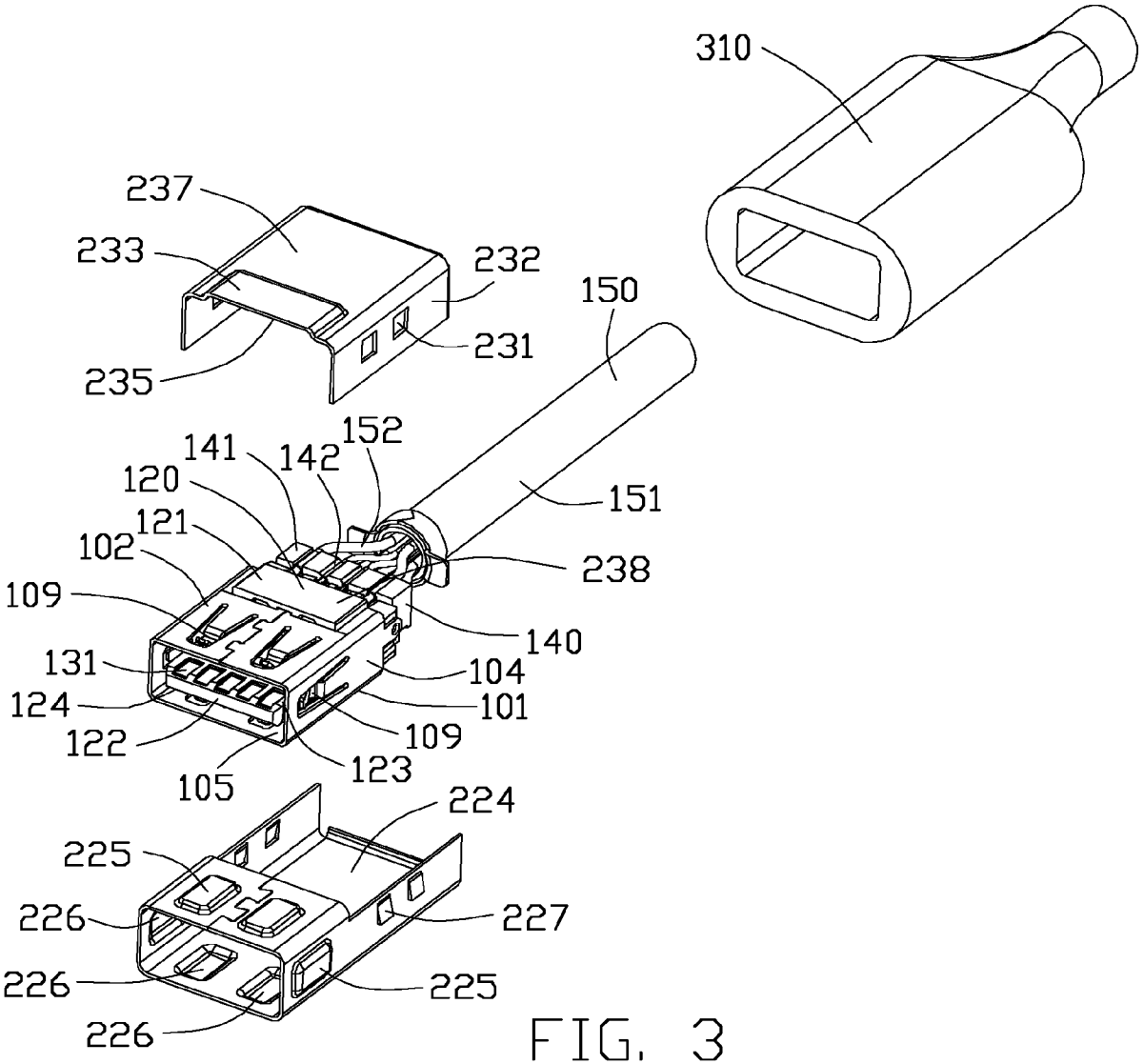
FIG. 3 is a further exploded perspective view of the receptacle connector assembly as shown in FIG. 2.
Figure 4:
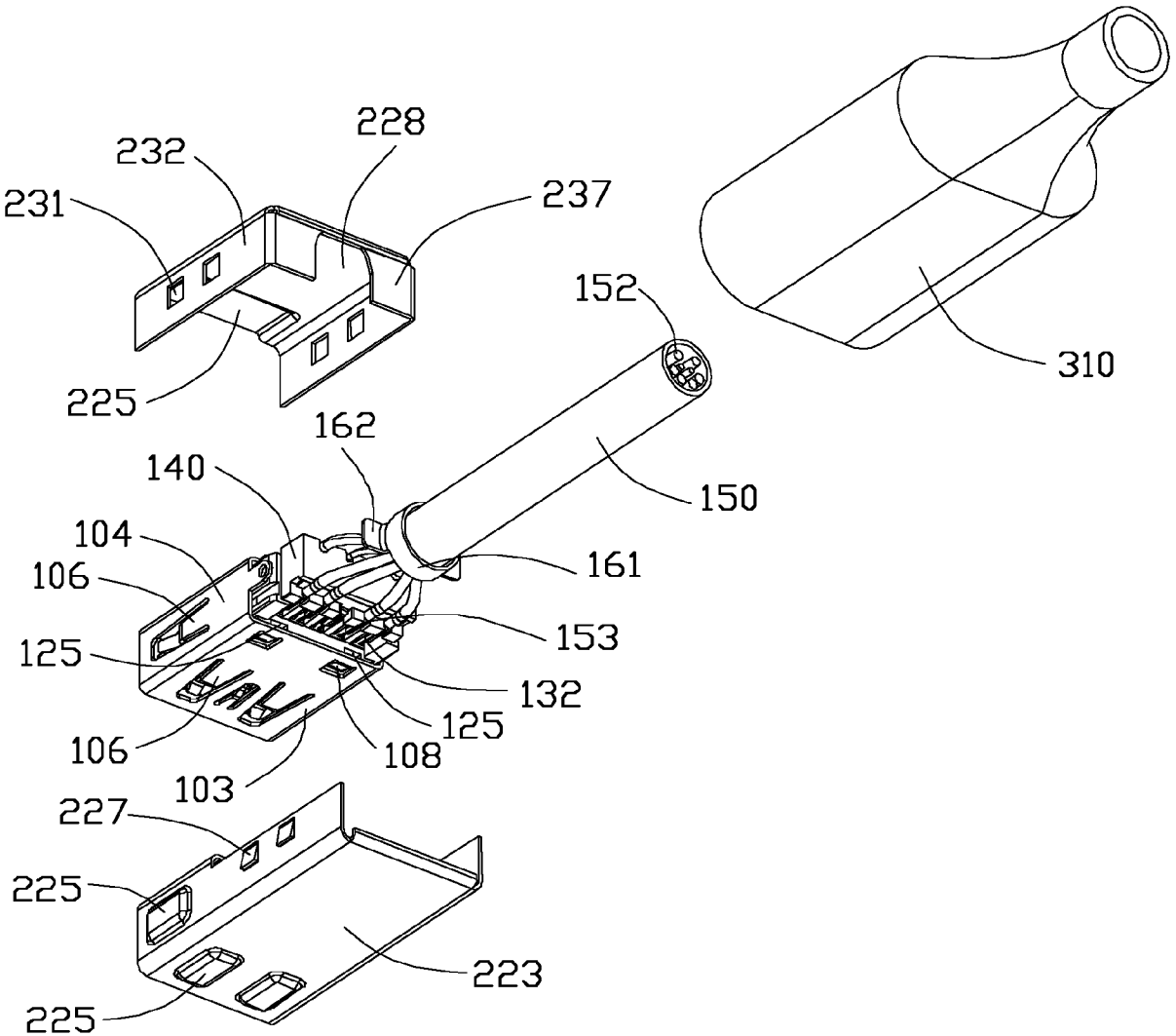
FIG. 4 is rear exploded perspective view of the receptacle connector assembly as shown in FIG. 3.
Figure 5:
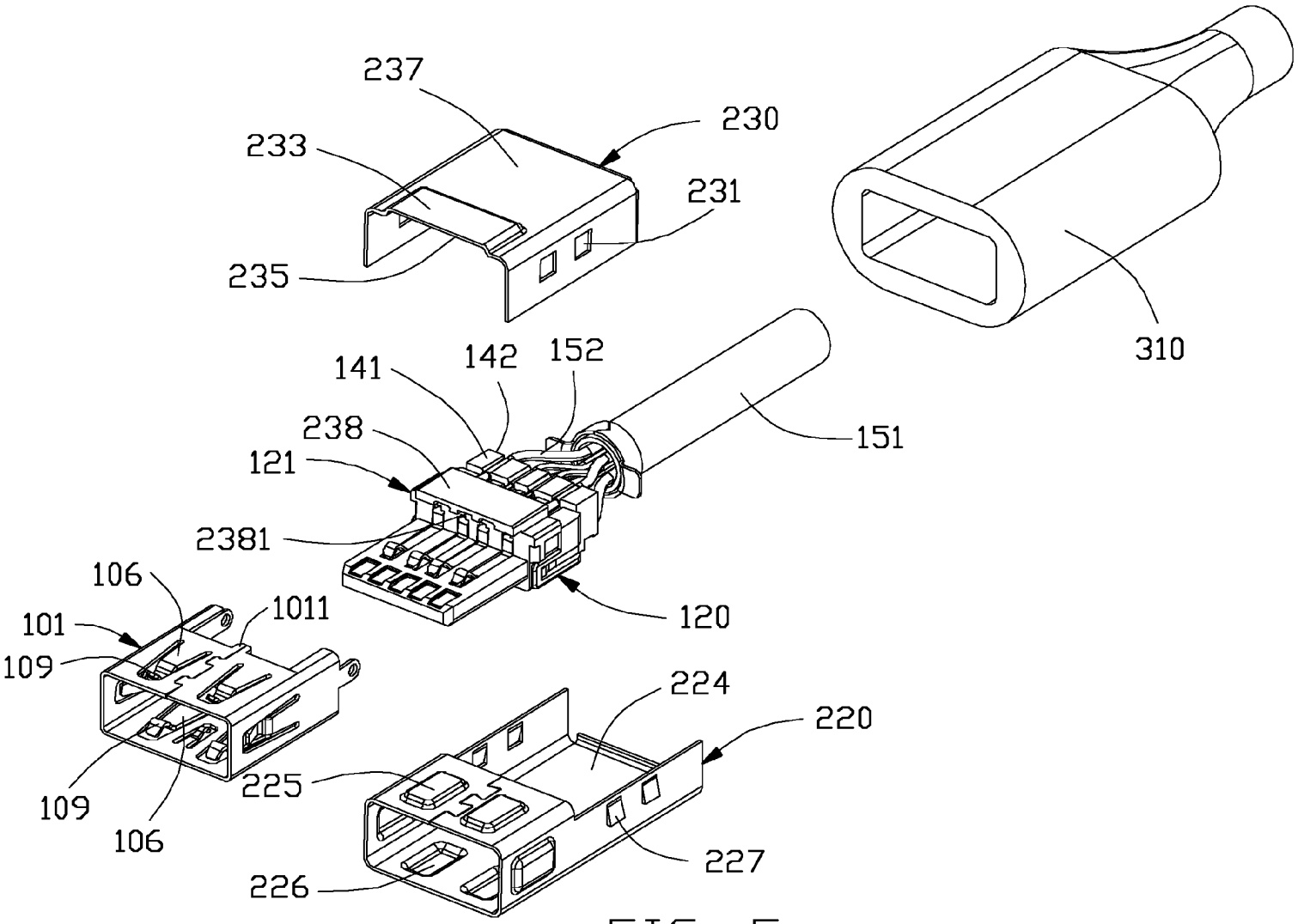
FIG. 5 is a further exploded perspective view of the receptacle connector assembly as shown in FIG. 3.
Figure 6:
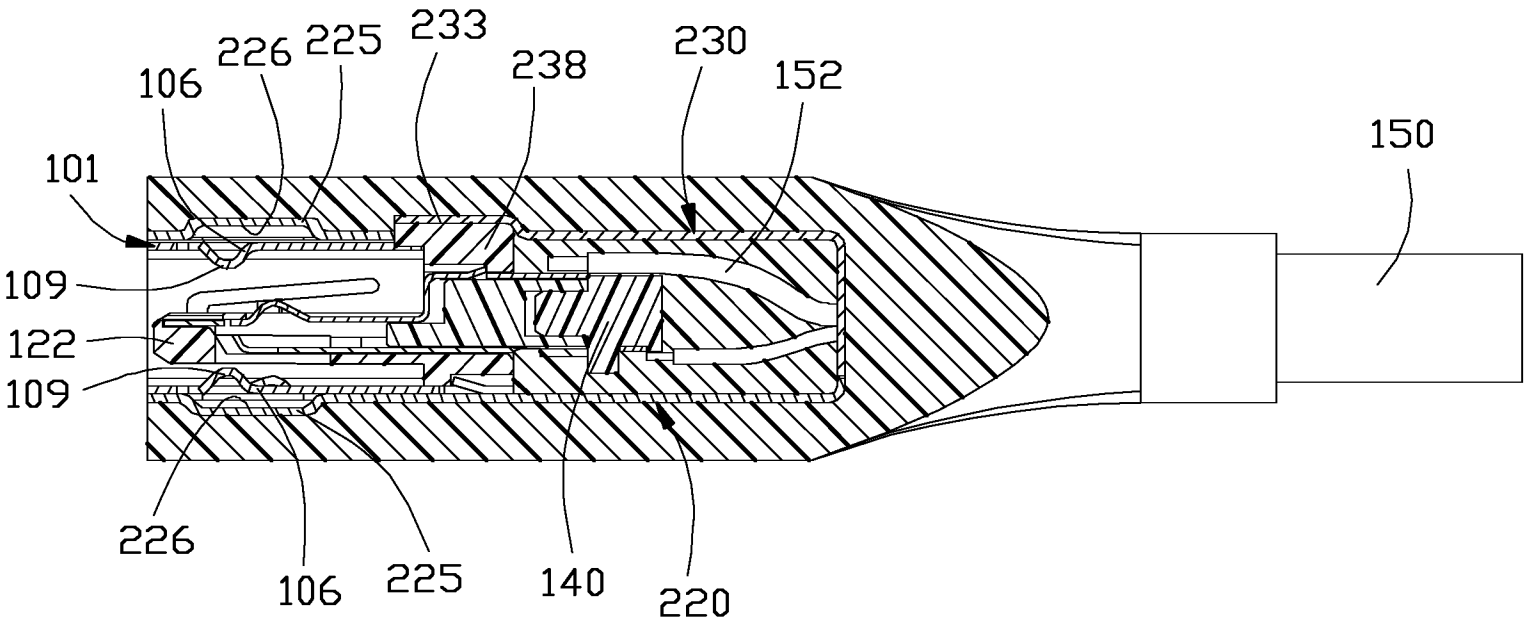
FIG. 6 is a cross-sectional view of the receptacle connector assembly as shown in FIG. 1.

Referring to FIGS. 1 to 6, a receptacle connector assembly 100 includes a first or inner metallic shell 101 having a top wall 102, a bottom wall 103, two lateral walls 104, and a receiving cavity 105 surrounded by the walls.

The receiving cavity 105 extends therethrough along a front-to-back direction for a plug connector inserting therein. Each of the top wall 102 and the bottom wall 103 includes two cantilevered spring fingers 106 extending forwardly and downwardly into the receiving cavity 105. Each of the lateral walls 104 includes one cantilevered spring finger 106 extending forwardly and inwardly into the receiving cavity 105. The bottom wall 103 forms two spring tabs 108 extending forwardly and upwardly therefrom and located behind the spring fingers 106, respectively. Each of the spring fingers 106 has a front triangle peak 109 protruding inwardly into the receiving cavity 105. The front free end of the spring finger 106 is detachable with a force applied to the front triangle peak 109.

An insulative body or housing 120 has a base 121 and a tongue 122 extending forwardly therefrom. The tongue 122 received in the receiving cavity 105 has a top face 123 and a bottom face 124 extending along the front-to-back direction. The base 121 extends backwardly out of the top wall 102. The base 121 forms two positioning grooves 125 recessed upward from a bottom wall thereof. The spring tabs 108 extend into the positioning grooves 125, respectively, for preventing backward movement of the body 120 from the first shell 101. On the other hand, a raised section 238 (illustrated later) of the base 121 may stop the forward movement of the body 120 with regard to the first shell 101. Therefore, the body 120 and the first shell 101 are secured to each other without relative movement therebetween in the front-to-back direction. In this embodiment, the first shell 101 further includes a lance 1011 piercing into a corresponding groove 2381 of the raised section 238 so as to secure the body 120 and the first shell 101 without relative movement in a vertical plane perpendicular to the front-to-back direction.

A plurality of contacts 130 are arranged in a side-by-side manner along a transverse direction perpendicular to the front-to-back direction and the vertical direction. Each of the contacts 130 has a contacting portion 131 exposed on the top face 123, a mounting portion 132 extending backwardly out of the first metallic shell 101, and a retaining portion located therebetween and held by the tongue 122.

A spacer 140 assembled to the base 121 along a back-to-front direction has a plurality of ribs 141 spaced each other along a transverse direction and a plurality of mounting slots 142 extending therethrough along the front-to-back direction. Each of the mounting slots 142 is defined between two neighbored ribs 141.

A cable 150 includes an insulative sleeve 151 and a plurality of electrical wires 152 mounted axially in the insulative sleeve 151. Each of electrical wire 152 includes a front wire terminal 153 extending forwardly out of the sleeve 151 and connecting to the corresponding mounting portions 132. Each wire terminal 153 goes through a corresponding mounting slot 142. Each of the electrical wires 152 has a copper wire and an insulative sheath enclosing the copper wire.

A metallic holder 160 mounted on the front end of the sleeve 151 has a circular body 161 and two stoppers 162 protruding therefrom along the transverse direction.

A second or outer metallic shell 210 encloses the first metallic shell 101, the wire terminals 153, and the stoppers 162 therein. The second metallic 210 shell includes a primary or bottom shell 220 and a secondary or top shell 230 assembled thereto along the vertical direction. The top shell 230 is shorter than the bottom shell 220 along the front-to-back direction. Understandably, the front-to-back direction essentially refers to the direction along the front-to-back line including two opposite directions.

The bottom shell 220 has a front section 221 with four side walls enclosing the first metallic shell 101 and a rear section 223 with three side walls defining an upward U-shaped slot 224. The front section 221 forms a plurality of protrusions 225 extending outwardly and a plurality of escape holes 226 defined by the respective protrusions 225. Each spring finger 106 has a free end that is detachable into the corresponding escape holes 226 with a force applied to the free end. The rear section 223 forms a locking barb 227 protruding outwardly therefrom.

The top shell 230 is mounted on the rear portion 223. The top shell 230 cooperates with the bottom shell 220 to form a sealed space along the vertical direction. The top shell 230 has a locking hole 231 formed on a lateral wall 232 thereof and locking with the locking barb 227. The top shell 230 has a projection 233 protruding from a top wall 234 thereof and an upward slot 235 formed by the projection 233. The base 121 has a top/raised section 238 extending upwardly beyond the first metallic shell 101 and received in the slot 235. The top shell 230 includes a rear wall 237 with a mounting hole 228 extending therethrough along the front-to-back direction. The circular body 161 is received within the mounting hole 228 and mechanically and electrically connected to the second metallic shell 210. The stoppers 162 are received in the receiving room defined by the top shell 230 and lower shell 220. In this embodiment, the raised portion 238 functions as a stopper to have the top shell 230 forwardly abuts and the bottom shell 220 rearwardly abuts for securing the rear shell 210 in position with regard to the assembled insulative body 120 and front shell 101.

An insulative case 310 is over molded on the second metallic shell 210, the holder 160, and a front end of the insulative sleeve 151.

The shown end which the cable 160 is connected could be a USB 2.0 A type receptacle connector or USB 3.0 A type receptacle connector, and the other end (not shown) could be a USB type C plug connector or another type plug connector which is different to the shown end.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. In the instant invention other than preventing invasion of the insulative case 310 into the receiving cavity during overmolding the insulative case 310, understandably, not only the protrusion 225 shields the corresponding punch hole for EMI protection but also the escaping hole 226 receives the distal end of the spring finger 106 and optionally further applies a reaction force thereupon for enhancing the retention between the receptacle connector and the mated plug connector.

What is claimed is:

1. A receptacle connector assembly comprising:

a first metallic shell including a plurality of side walls, a receiving cavity surrounded by the side walls and extending therethrough along a front-to-back direction, a plurality of spring fingers formed on the respective side walls and protruding inwardly into the receiving cavity, and a plurality of punched holes receiving the respective spring fingers and communicating with the receiving cavity;

an insulative body including a base assembled to the first metallic shell and a tongue extending forwardly therefrom, the tongue received in the receiving cavity and having a top face and a bottom face disposed in a vertical direction perpendicular to said front-to-back direction;

a plurality of contacts arranged in a side-by-side manner along a transverse direction perpendicular to the front-to-back direction and the vertical direction, each contact having a contacting portion exposed on one of the top face and the bottom face;

a second metallic shell covering the first metallic shell and enclosing the punched holes therein; and an insulative case enclosing the second metallic shell.

2. The receptacle connector assembly as recited in claim 1, wherein the insulative case is over molded on the second metallic shell.

3. The receptacle connector assembly as recited in claim 1, wherein the second metallic shell includes a plurality of protrusions extending outwardly and a plurality of escape holes defined by the respective protrusions, and each spring finger has a free end detachably engaging into a corresponding escape hole by applying a force to the free end.

4. The receptacle connector assembly as recited in claim 1, wherein each of the contacts includes a mounting portion extending backwardly out of the first metallic shell.

5. The receptacle connector assembly as recited in claim 4, further comprising a cable with an insulative sleeve and a plurality of electrical wires mounted axially in the insulative sleeve, each wire including a front wire terminal extending forward out of the sleeve and connecting to a corresponding mounting portion.

6. The receptacle connector assembly as recited in claim 5, wherein the second metallic shell encloses the front wire terminals therein.

7. The receptacle connector assembly as recited in claim 5, further comprising a metallic holder mounted on the front end of the sleeve, the second metallic shell including a rear wall with a mounting hole extending therethrough along the front-to-back direction, the holder received within the mounting hole and mechanically and electrically connected to the second metallic shell.

8. The receptacle connector assembly as recited in claim 1, wherein the second metallic shell includes a bottom shell and a top shell assembled thereto along the vertical direction, the top shell is shorter than the bottom shell along the front-to-back direction.

9. The receptacle connector assembly as recited in claim 8, wherein the bottom shell has a front section with four side walls enclosing the first metallic shell and a rear section with three side walls defining an upward U-shaped slot.

10. The receptacle connector assembly as recited in claim 9, wherein the top shell is mounted on the rear portion and cooperates with the bottom shell to form a sealed space along the vertical direction.

11. The receptacle connector assembly as recited in claim 8, wherein the top shell has a locking hole and the bottom shell has a locking barb inserted into the locking hole.

12. The receptacle connector assembly as recited in claim 8, wherein the top shell has a projection protruding upwardly from a top wall thereof and a slot formed by the projection, and the base has a top section extending upwardly beyond the first metallic shell and received in the slot.

13. A cable connector assembly comprising:

an insulative housing defining a base and a tongue forwardly extending from the base along a front-to-back direction;

a plurality of contacts disposed in the housing with contacting sections exposed upon the tongue;

a plurality of wires located behind the housing and connected to the corresponding contacts, respectively;

a metallic inner shell attached to the housing and including a plurality of side walls to commonly form thereon a receiving cavity in which the tongue extends;

a plurality of spring fingers stamped from the corresponding side walls and extending into the receiving cavity, respectively, to form a plurality of punched holes surrounding the corresponding spring fingers, respectively;

a metallic outer shell attached to at least one of said housing and said inner shell; wherein said outer shell extends in the front-to-back direction to shield not only a front end portion of the cable for protection of an joint between the wires and the corresponding contacts, but also the inner shell with a plurality of transversely outward protrusions intimately and transversely aligned with the corresponding spring fingers and punched holes associated therewith so as to not only transversely shield the corresponding punched holes against Electro-Magnetic Interference (EMI) but also provide sufficient space to allow distal tips of the corresponding spring fingers to transversely leave the corresponding punched holes and be received therein without interference when a complementary plug connector is received within the receiving cavity.

14. The cable connector assembly as claimed in claim 13, further including an insulative case intimately overmolded upon the outer shell, wherein the transversely outward protrusions not only prevent the insulative case from invading the receiving cavity during molding, but also are embedded within an interior face of the case so as to prevent a relative movement of the case with regard to the outer shell after the insulative case is solidified.

15. The cable connector assembly as claimed in claim 13, wherein said outer shell includes a primary part and a secondary part assembled to each other in a vertical direction perpendicular to said front-to-back direction, and said primary part is rearwardly assembled upon the inner shell along said front-to-back direction.

16. The cable connector assembly as claimed in claim 15, wherein said base forms a raised portion against which said secondary part forwardly abuts and said primary part rearwardly abuts so as to secure said outer shell in position regard to the housing along said front-to-back direction.

17. A method of making a cable connector assembly for mating with a plug connector, comprising steps of:

providing an insulative body with a base and a tongue forwardly extending from the base along a front-to-back direction;

providing a plurality of contacts upon the body with contacting section exposed upon the tongue;

attaching a metallic inner shell upon the body along said front-to-back direction to form a receiving cavity in which said tongue extends; and forming a plurality of spring fingers on the inner shell via stamping so as to from a plurality of punched holes associated with the corresponding spring fingers, respectively, wherein each of said spring fingers forms an contacting peak extending into the receiving cavity when no plug connector is received within the receiving cavity, and a distal end outwardly projecting outside of the corresponding punched hole when the plug connector is received within the receiving cavity; and attaching a metallic outer shell upon the inner shell with a plurality of transversely outward protrusions intimately transversely aligned with the corresponding spring fingers to not only transversely shield the corresponding punched hole for EMI (Electro-Magnetic Interference) protection but also provide a space to receive the distal end of the corresponding spring finger therein.

18. The method as claimed in claim 17, further including a step of overmolding an insulative case upon the outer shell, wherein said transversely outward protrusions are embedded within the insulative case.

19. The method as claimed in claim 18, wherein said inner shell is rearwardly assembled to the body along the front-to-back direction.

20. The method as claimed in claim 18, wherein the outer shell includes a primary part and a secondary part assembled to each other in a vertical direction perpendicular to said front-to-back direction, and said body includes in said vertical direction a raised section against which said outer shell is secured to the body without relative movement therebetween in said front-to-back direction.

* * * * *